United States Patent [19]

Andoe

[11] Patent Number: 5,044,293

[45] Date of Patent: Sep. 3, 1991

[54] METHODS OF UTILIZING ANTI-FOULING MATERIAL IN MARINE VESSEL HULL CONSTRUCTION

[75] Inventor: Graham C. Andoe, Fort Lauderdale, Fla.

[73] Assignee: Andoe, Inc., Atlanta, Ga.

[21] Appl. No.: 409,072

[22] Filed: Sep. 19, 1989

[51] Int. Cl.[5] ..... B63B 3/00; B63B 5/24

[52] U.S. Cl. ..... 114/88; 114/222; 114/356; 114/357; 156/71

[58] Field of Search ..... 114/84, 86, 88, 222, 114/356, 357; 422/6; 156/71, 153, 245; 264/256, 257

[56] References Cited

U.S. PATENT DOCUMENTS

| | | | |
|---|---|---|---|
| 37,998 | 3/1863 | Barnard | 114/84 |
| 749,909 | 1/1904 | Upham | 114/84 |
| 3,761,334 | 9/1973 | Zondek | 114/222 X |
| 3,802,906 | 4/1974 | Van Gils | 156/153 X |
| 3,971,084 | 7/1976 | Spier | 114/357 |

FOREIGN PATENT DOCUMENTS

| | | | |
|---|---|---|---|
| 1212692 | 8/1989 | Japan | 114/356 |

*Primary Examiner*—Sherman Basinger
*Attorney, Agent, or Firm*—H. Jay Spiegel

[57] ABSTRACT

The present invention relates to a new method of protecting the hulls of marine vessels from fouling. The inventive method includes the application of thin metallic films as an integral part of hull manufacturing processes. The inventive method also includes the use of various techniques for application of a film, structures that aid in the application of the film as well as for preventing impact damage to the film and hull. Also included are surface preparation steps relating to the film material as being performed prior to the film's integration onto a vessel hull.

21 Claims, 2 Drawing Sheets

METHODS OF UTILIZING ANTI-FOULING MATERIAL IN MARINE VESSEL HULL CONSTRUCTION

BACKGROUND OF THE INVENTION

Firstly, applicant wishes to incorporate by reference disclosure documents number 200,011 and number 228,022 which were filed on Aug. 26, 1988 and May 25, 1989, respectively, and a disclosure document entitled "A NEW MARINE VESSEL CONSTRUCTION MATERIAL WITH INTEGRAL NON-POLLUTING ANTI-FOULANT" which was filed on Apr. 1, 1987 in the United States Patent and Trademark Office.

This patent application discloses inventions which constitute improvements over an invention disclosed in U.S. Pat. No. 4,772,344 to Andoe dated Sept. 20, 1988; the Andoe patent is hereby incorporated by reference.

Applicant's prior patent discloses a method of installing a copper material on the hull of a vessel such that no contact is permitted between the copper material and any and all dissimilar metals. Also disclosed therein is a new passive or active cathodic protection system which reduces the corrosion of the copper material that has been attached to the vessel. In conjunction with the attaching of the copper material to a hull of a vessel, a dielectric barrier is disclosed having dielectric characteristics that reduce the galvanic corrosion effects, the dielectric barrier being interposed between the copper material and dissimilar metals.

The prior patent also discloses uses of the improved dielectric barrier in areas of overlap as well as pretreatments of areas to be overlapped to enhance bonding between materials. The prior patent discloses, as advantages of the inventive method, extended vessel life by installing the improved copper material to a hull of a vessel, reduced hull damage and corrosion, improved bonding of the copper material onto a hull and improved economics regarding the installation method per se. The following areas of the aforementioned issued patent have been found to necessitate further research to find improved ways of installing the copper foil material and protecting the hull of a vessel:

(a) Bonding between the hull and the copper material as well as at overlap joints in certain commercial, marine vessel and pleasure boat applications has been difficult to achieve and maintain.

(b) Impacts to the hulls of vessels, especially in the keel areas have caused damage to the copper foil material that has been installed on a hull.

(c) A more economical and quicker installation process is needed to further reduce wasted copper materials as well as installation time.

(d) Adjacent strips of the copper material have differing electrical potentials thereby increasing galvanic corrosion effects.

(e) Seams of the adjacent strips also have a high incidence of repair due to impact damage.

SUMMARY OF THE INVENTION

The present invention relates to an improved method of protecting the hull of a vessel from corrosion and damage. The present invention includes the following interrelated aspects and features:

(a) In a first aspect, the present invention provides an improved method of installing a copper material to the hull of a vessel. In this method, the copper material is adhered to the outer surface of the vessel during the manufacturing process of the hull itself. As such, the copper material of the present invention becomes an integral part of the hull through the manufacturing process. This improved method may include process steps performed on the copper material prior to its application to a hull involving flattening, cleaning, joining and surface preparation to promote adhesion of the copper material to the hull.

(b) In the method of installing the copper material to a hull, an improved joining device may be utilized to secure adjacent panels together as well as to reduce galvanic corrosion between the panels, to minimize damage at junction areas of adjacent strips of copper material and to facilitate inspection of hull areas. This joining device having a T-shape is generally located in the gap between adjacent panels of the copper material, the upper leg of the tee contacting the exterior surfaces of adjacent copper panels with the lower portion thereof located in the gap between the adjacent panels. The joining device may be adhered to the copper material by the dielectric barrier of the present invention. The joining device acts to absorb impact by flexing of the upper leg portion of the device coupled with the vertical movement of the lower portion as well as by compression of the dielectric barrier.

(c) As a further step in installing the copper material in the hull of a vessel, an additional impact resistant material may be installed over the copper material in preselected areas of the hull to minimize damage to the copper material as installed on the hull. The impact resistant material may be a copper alloy containing strengthening alloying elements such as chromium or nickel in amounts known to impart strength and wear resistance to copper alloys.

(d) In a further aspect, an improved method of manufacturing marine vessel hulls including the anti-fouling copper material includes making a composite hull structure utilizing a thermoplastic composite bonded to the copper material, thereby producing a hull having high strength, light weight, low cost and the anti-fouling outer copper material layer.

Accordingly, it is a first object of the present invention to provide a new and improved method of installing a copper material to the hull of a vessel.

It is further object of the present invention to provide an improved joining device to be used in combination with the inventive anti-fouling material of the present invention.

It is a yet further object of the present invention to provide an improved anti-fouling material having a protective impact resistant material thereon for minimizing damage to the copper foil material.

These and other objects, aspects and features of the present invention will be better understood from the following specific description of the preferred embodiments when read in conjunction with the appended drawing figure.

SPECIFIC DESCRIPTION OF THE PREFERRED EMBODIMENT

Figure 1:
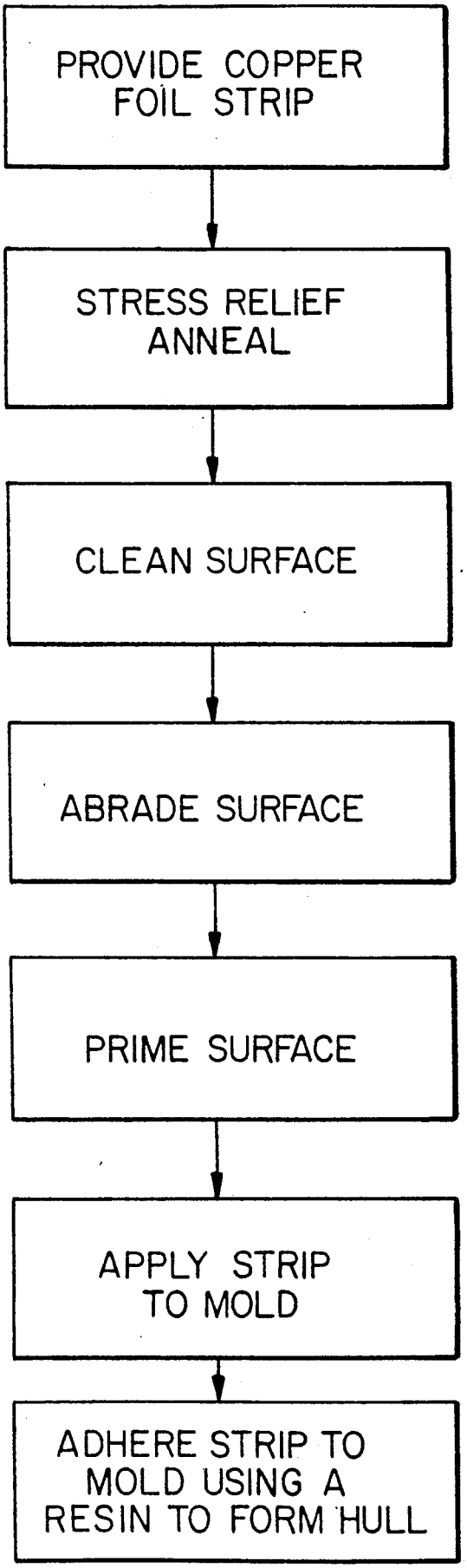
FIG. 1 shows a schematic representation of an embodiment of the inventive process.

The present invention combines specific structure with specific techniques so as to overcome each and every one of the deficiencies as set forth hereinabove in the Background of the Invention.

As an improvement over the method of installing an anti-fouling material onto the hull of a vessel, and the method of producing a vessel hull by using a vessel mold wherein the vessel hull is produced by the "laying up" method or other known methods similar thereto, applicant has discovered that impact damage at seams, waste in material due to overlap, bonding failures and formation of surface defects such as cracks and bubbles may be minimized by including as an integral part of these types of hull manufacturing methods, the step of including the copper material as an outer anti-fouling material during the actual manufacturing process of making the hull.

In the inventive method, the copper material must be contoured to fit the interior of the mold, either male or female, from waterline to the keel and back to the waterline. It has been found that exact hull contours should be followed in applications where the copper material will follow compound curves of the hull. In one embodiment, the copper material is preferably cut into strips that face fore and aft or that face an angle mostly fore and aft, with a maximum width of 54 inches. After being cut, the copper material is laid in a female mold or upon a male plug mold. The copper material and the mold or plug may be separated by a mold release compound to facilitate removal of the finished hull from the mold.

Prior to making the copper material an integral part of a hull, the surface of the copper material may be prepared prior to placing the copper material adjacent the mold so as to improve successful hull-to-copper material bonding.

It has been discovered that in certain applications proper bonding of these sections to a hull is difficult to achieve and maintain. One source of this difficulty besides the presence of the contaminants such as oil, dirt, etc., is oxidation products formed on the surface of a copper nickel sheathing. Formation of the oxidation products is enhanced by the exposure of the sheathing to marine salt air prior to bonding to a hull. As a solution to the problem of bonding the sheathing to the hull of the vessel, the copper nickel material may be subjected to a cleaning step prior to the bonding step. This cleaning step may include subjecting the copper nickel sheathing to an acid wash by immersion or spraying techniques, the acid being of a known type that will remove oxidation products from copper alloy strips. Alternatively, a mechanical cleaning or abrading step may be employed utilizing techniques such as shot blasting, shot peening, brushing or sanding. A preferred device for cleaning the surface of the copper strip materials includes a descaling machine commonly referred to as a PANGBORN descaler in the field of cleaning of metallic strip materials.

As an adjunct to improved bonding applications, applicant has discovered that etching or producing a particular surface finish on the copper alloy strip material prior to application to a hull enhances the bonding between the copper alloy strip and the hulls of vessels. This surface finish can be achieved through the chemical or mechanical cleaning step aforementioned to obtain a preferred surface finish of between about 20 grit, to 400 grit. The particular surface finish needed to achieve enhanced bonding may depend upon such variables as copper alloy strip thickness, bonding adhesive thickness, bonding strength requirements, etc. It has been found that in applications where the thickness of the adhesive between the copper alloy strip and hull is small, a finer surface finish on the copper alloy strip will be sufficient to achieve the requisite bonding strength, with the thicker adhesive applications requiring a coarser surface finish on the copper alloy material. Without this mechanical abrading of the surface, it has been found that in aluminum hull applications the bond strength of the dielectric adhesive is approximately 500 pounds per square inch resulting in premature failures. However, in aluminum hull applications using the inventive mechanical abrading step, bond strengths are approximately 2800 pounds per square inch, roughly an increase of five times. Using this mechanical abrading step, bonding failures have been attributed to the adhesive itself rather than the adhesive-copper strip material interface.

In another embodiment, the copper alloy strip may be first cleaned using an acid wash as described hereinabove followed by a subsequent mechanical abrading step to produce the desired surface finish.

Once a cleaning step or cleaning and abrading steps have been performed to the copper alloy strip and the copper alloy strip is not scheduled to be applied to the hull within 20 minutes, the surface of the strip material must be sealed or primed to protect it from further contamination due to unwanted oils, dirt or oxidation products.

This sealing or priming step may be performed using any known primer material commonly employed to prevent oxidation of copper alloy materials and materials that are compatible with the copper alloy material. As a preferred primer, the improved dielectric barrier described hereinabove may be utilized as the priming material. The thickness of the primer material may vary depending on the thickness of the copper alloy strip but a preferred thickness ranges between 0.001 to 0.002 inches.

Another problem associated with commercial application of the copper material is that the sections of material are not flat prior to making them a part of a hull of the vessel. This unevenness in the strip material is a result of residual rolling stresses remaining in the material after the last rolling operation. These internal stresses result in the strips of copper material exhibiting curving in both longitudinal and transverse directions. These curves cause difficulty in proper adhesion of the copper strip material to a hull. To solve this problem, applicant has discovered that stress relief annealing the copper strip material prior to applying it on a hull reduces the internal stresses in the material and produces a flatter product that has improved adhesion to the hull. This stress relief annealing step is conducted using parameters well known in the field of stress relief annealing of strip material and exact operating parameters are not considered an aspect of the present invention. Once the material has been stress relieved, it may be subjected to the above-described cleaning and/or abrading and priming steps prior to application onto the hull of a vessel.

Once the surface has been properly prepared as described hereinabove, the copper material may be adhered to said mold in any known fashion such as using a mold release agent, followed by the steps of laminating and constructing the hull as is known in the art of making fiberglass or other non-metallic hulls. In these known methods, the resins that normally bind fiberglass or other material interior layers successfully bind the copper material to the exterior of the hull. As such, the copper material laid onto the mold then becomes an integral part of the hull. Any holes in the copper material may be precut either by known computer techniques or by hand, all through hull areas having the required dielectric separation distance installed as the hull is laminated. The hull is secured using known methods and is released from the mold in known manners. FIG. 1 shows a schematic block diagram of one embodiment of the inventive process as described above.

As an alternative mode, the copper strip typically in widths varying from 12 to 54 inches may be joined together by any known method such as welding brazing, flame spraying, crimping, etc., such that the copper material strips have been fabricated into a single panel that may be applied to a hull. This panel should match the surface configuration of the hull of which the copper material is to be a part. In this embodiment, the single copper material panel, after any trimming is performed either by computer techniques or by hand, may be placed on a male mold or in a female mold and contoured to the mold by pneumatic or hydraulic pressing, die stamping or other known methods that would shape the copper material according to the contour of the mold. The result of this method is that the copper anti-fouling material conforms exactly to the hull contour with no seams or overlaps. After this step has been performed, the copper material may be attached or made part of a hull by a plurality of methods such as eliminating the gelcoat outer layer of a hull and actually bonding the hull to the copper material by using the laminating-resin systems typically employed in known marine vessel construction system practices, for example, the "lay-up" method or by any other known compatible adhesive or bonding systems.

In the single panel mode of the present invention, surface preparation, panel size permitting, may be performed as described hereinabove prior to the joining step aforementioned or subsequently thereto.

In another mode of manufacturing a hull, the copper material may be combined with a thermoplastic material to produce a hull material that may replace steel, aluminum, wood and fiberglass. This new method of manufacturing a hull includes providing a copper foil material and heat bonding to it a thermoplastic material such that the composite material has the strength of steel, the low cost of a recyclable thermoplastic, and an integral anti-fouling outer layer of a copper alloy material.

This thermoplastic material may be any fully polymerized glass, carbon, KEVLAR, or other similar type thermoplastic composite which can be heat bonded to the anti-fouling copper material of thickness between 0.005 and 0.5 inches.

This embodiment may be used for mold applications for marine vessel hulls. The copper material intended to be the outer hull surface is prepared and applied to the desired mold as described above regarding surface preparation, matching the mold surface configuration, and being applied to the mold. Once the copper material is applied to the mold, a thermoplastic polymerized composite inner layer is placed adjacent to the inner mold layer of copper material and is heated to cause the thermoplastic to curve to the shape of the mold and to bond the thermoplastic material to the copper material.

For large commercial applications the composite material may be formed into straight or curved structural plates and may be heated in place to effect the bonding, or may be preformed into sections similar to ship steel plates and then the sections may be chemically bonded together in a known manner.

Prior to applying the thermoplastic to the copper material, the thermoplastic material may be placed in a mold and polymerized at a high temperature, cutting away any wasted material. The wasted material may be recycled in further applications. This fully polymerized composite is stamped or compression molded into sheets cut to standard or custom sizes. The composite may then be heated to just below its melting point to mold the composite shape to a final shape and to bond it to an outer skin of the copper material as described above.

The thermoplastic copper material laminate may be made for ship plates that are either bonded or through fastened, either in flat or curved shapes. Alternatively, the laminate may be produced as straight or curved boat planks, custom sized repair sections or for boat mold layup methods. When applied in sections, for example, 24 inches wide by up to 65 feet long, waterline to keel to waterline or stern to stern, the joint between sections may become an integral stringer. The exterior edges of the formed sections may be covered by a strake that is bonded to each section. Ribs may then be bonded to the hull at end joints of the sections.

The method of the present invention provides the advantage that the copper material may be made integral with a hull without the use of extra bonding adhesives as would be the case if the copper material were to be applied to an already manufactured hull. With the copper material integrally bonded to the vessel hull, surface defects in the hull are greatly minimized. For example, fiberglass surface defects have been known to cost about $5 per square foot of hull area to repair, such a cost virtually eliminated by using the inventive method. The presence of the copper material on the outer surface of the hull also prevents the absorption of water through a hull. It has been found that up to 2,300 pounds of water may be absorbed in a 44 foot marine vessel. With the copper material on the outer surface of the hull, less expensive resins may be used in place of the more expensive water resistant formulations. Additionally, utilizing the single panel embodiment, seams and areas of overlap are eliminated thereby eliminating areas where bonding failures may occur as well as improving vessel performance by reducing drag.

In another aspect of the invention a shock absorbing, sacrificial repairable metallic coupling has been designed to improve performance of the copper material applied to hulls of vessels. It has been found that large sheets of the copper material may have different electrical potentials due to variations in composition, temper and operating condition of the vessel. As such, there exists a non-uniform, nonhomogeneous electrical potential between these large sheets of material, thereby enhancing galvanic corrosion protection.

The improved joining device of the present invention is designed to overcome the problems associated with galvanic corrosion between adjacent sheets of the applied copper material. The improved joining device also has the additional benefit of acting as an impact barrier thereby contributing to the service life of the copper material. The improved joining device may also act as a repair point and a hull inspection point.

Figure 2:
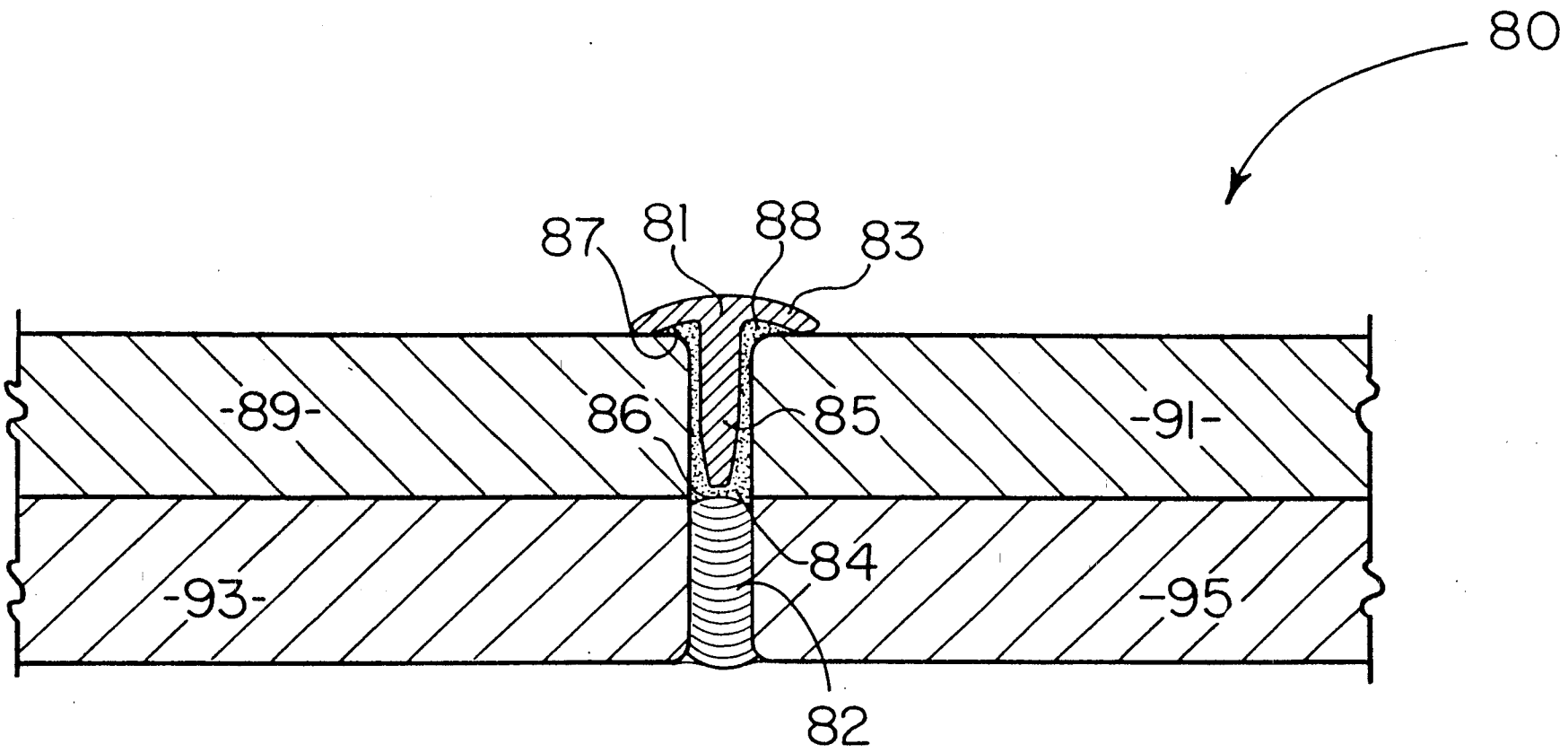
FIG. 2 depicts the joining device in a use of the present invention.

With reference to FIG. 2, the improved joining device is generally designated by reference numeral 80, and is seen to include the joining device itself 81 having an upper conducting portion 83 which is intended to maintain the freely eroding abilities of each and every panel and a vertical spacing portion 85. As can be seen from the drawing, joining device 81 is positioned between the two panels 89 and 91 of the copper material, the panels 89 and 91 attaching to vessel hull panels 93 and 95. Between vessel hull panels 93 and 95 is weld 82 connecting the hull panels. Between weld 82 and vertical spacing portion 85 is a gap 84. Within the gap 84 may be a dielectric barrier 86 which acts as a cushion to absorb any impact against surface 83 as well as a means to adhere the joining device 81 to the panels of copper material and the hull of vessel. The height of the opening 84 as well as the depth of the vertical spacing portion 85 may vary depending on the thickness of copper panels 89 and 91 and the height of weld 82. The gap 84 is configured to receive dielectric adhesive 86 and to absorb severe impacts, thereby allowing the vertical spacing portion 85 to extend therein from any impact.

The joining device 81 also has a curved under recess surface 87 forming a gap 88. In the event of severe impact upon joining device 81, the surface 87 flexes inwardly acting as a cushion to absorb impact and minimize damage to the hull. The gap 88 while allowing the aforementioned flexing of surface 87 also may act as a repair point such that damage to the hull may be repaired by filling the gap 88 with dielectric adhesive.

The joining device is made from a predominantly copper material with the upper conducting T-shaped portion 83 being matched in composition to the vertical spacing portion 85. The joining device should also be made from a copper material that is galvanically compatible with the composition of the panels 89 and 91.

As an adjunct to the joining device of the present invention, an impact shoe is disclosed providing improved performance of said copper material by protecting the copper material from damage such as tearing or wearing through severe impacts. The impact shoe may be in a form of a sheet or strip material made from an alloy that is galvanically compatible with a copper material adhered to the hull. A preferred material would include a predominantly copper alloy with the addition of alloying elements typically known in the art to provide wear resistance and increased strength in copper based alloys. Examples of these alloying elements include nickel and chromium. These alloying ingredients are typical of copper base alloys containing these strengthening elements and are well known in the art of nonferrous alloy compositions. The sheet thickness may vary from the thickness of the copper material itself to up to three quarters of an inch thick. The impact shoe may be applied to the hull of a vessel already containing the copper material clad to the bottom of a vessel keel or keels thereby protecting these sections during impact. The impact shoe may be applied using the same techniques as described hereinabove for attaching the copper material to a vessel hull, for example, by using the disclosed dielectric adhesive.

Applicant has found that application of the copper material to a boat hull in the manner described hereinabove results in the following advantages:

(1) More efficient boat operation results due to less drag;

(2) Corrosion between the hull and attached copper material is reduced;

(3) Surface defects, such as osmotic blistering are reduced;

(4) Impact damage to the copper material is reduced;

(5) Improved inspection access is provided;

(6) Damage to seams and joints is more easily repaired;

Accordingly, an invention has been disclosed herein which overcomes each and every one of the deficiencies in the prior art as discussed hereinabove and which provides a new and improved method of installing a copper foil on a vessel hull which is greatly reduced in cost and results in greatly increased life. Various changes, modifications and alterations may be contemplated by those skilled in the art to the teachings of the present invention; such modifications, changes and alterations are intended to be construed as being included in the teachings of the present invention. Accordingly, it is intended that the present invention only be limited by the terms of the appended claims.

I claim:

1. In the method of manufacturing a marine vessel hull including the steps of providing a mold having a surface configuration corresponding to a vessel hull surface configuration and laminating a plurality of layers of a fiberglass material together using a resin and said mold to form said vessel hull, the improvement comprising the steps of:

(a) prior to said laminating steps, providing at least one predominantly copper foil strip having a continuous first and a continuous second surface;

(b) a stress relief annealing said predominantly copper foil strip to improve flatness and promote bonding;

(c) applying at least one said predominantly copper foil strip on said mold such that said predominantly copper foil strip corresponds to said surface configuration of said mold;

(d) manufacturing said hull by laminating a plurality of layers of fiberglass material to said predominantly copper foil strip using a resin;

(e) wherein said predominantly copper foil strip becomes an integral part of said hull.

2. The method of claim 1 including, prior to said applying step, cleaning at least a first surface of said predominantly copper foil strip to remove substantially all surface contaminants from said at least first surface.

3. The method of claim 2 wherein said cleaning step comprises mechanically abrading at least a first surface of said predominantly copper foil strip.

4. The method of claim 3 wherein said mechanical abrading step produces a surface finish between about 20 and 400 grit on said at least first surface.

5. The method of claim 2 wherein said cleaning step comprises chemically removing said contaminants.

6. The method of claim 5 wherein said chemical removing step produces a surface finish of between about 20 to 400 grit on said at least first surface.

7. The method of claim 2 including mechanically abrading at least a first surface of said predominantly copper foil strip after said cleaning step to produce a surface finish of about 20 to 400 grit on said at least first surface.

8. The method of claim 1 wherein said at least one predominantly copper foil strip comprises a plurality of copper foil strips which when placed in said mold collectively correspond to said surface configuration of said mold.

9. The method of claim 8 including prior to said applying step, cleaning at least a first said surface of each copper foil strip to remove contaminants therefrom to improve bonding performance.

10. The method of claim 8 including cleaning at least a first said surface of each said predominantly copper foil strip subsequent to said stress relief annealing to remove contaminants on said strip.

11. The method of claim 8 including, prior to said applying step, joining said plurality of predominantly copper foil strips together to form said at least one predominantly copper foil strip.

12. The method of claim 11 wherein said joining step comprises metallureically bonding.

13. The method of claim 11 wherein said joining comprises mechanically engaging.

14. The method of claim 11 including the further step of cleaning at least a first surface of said at least one predominantly copper foil strip to remove contaminants on said at least first surface.

15. An improved joining device for minimizing galvanic corrosion and impact damage to panels of antifouling material clad to a hull of a vessel comprising:

(a) an upper conducting rib portion made of a predominantly copper material adapted to extend longitudinally across a joint formed by adjacent said panels and having a concave shape with respect to said adjacent panels; and (b) a vertical spacing rib portion made of a predominantly copper material adapted to extend longitudinally between said joint formed by adjacent said panels;

(c) said vertical spacing rib portion, being perpendicularly connected along said upper conducting rib at a central portion thereof; said forming device having a tee-shaped cross-section.

16. An improved joining device for minimizing galvanic corrosion and impact damage to panels of antifouling material used in marine hull construction including:

(a) a plurality of predominantly copper foil material panels clad to a hull of a vessel, adjacent said panels forming a joint therebetween;

(b) an improved joining device located between adjacent panels, said joining device further comprising:

(i) an upper conducting rib portion made of a predominantly copper material adapted to extend longitudinally across said joint formed by adjacent said panels and having a concave shape with respect to said adjacent panels and (ii) a lower spacing rib portion made of a predominantly copper material adapted to extend longitudinally between said joint formed by adjacent said panels;

(iii) said lower spacing rib portion being perpendicularly connected along said upper conducting rib at a central portion thereof, said joining device having a tee-shaped cross-section;

(c) wherein said joining device reduces impact damage to a said joint, permits inspection of a said joint and acts as a sacrificial anode to reduce galvanic corrosion of said panels.

17. The invention of claim 16 wherein said joint is aligned with a weld joint of said hull, said lower spacing rib portion of said joint device, said weld joint and said adjacent panels forming a gap which allows said joining device to absorb impacts by said joining device flexing into said gap during impacts.

18. The invention of claim 17 further including an adhesive located between said joining device and said adjacent panels and in said gap.

19. The invention of claim 16 further including an adhesive located between said joining device and said adjacent panels.

20. The method of manufacturing at least a portion of a marine vessel hull including the steps of:

(a) providing a mold having a surface configuration corresponding to at least a portion of a marine vessel hull surface;

(b) providing at least one predominantly copper foil strip having a continuous first and second surface;

(c) stress relief annealing said predominantly copper foil strip to improve flatness and promote bonding;

(d) applying at least one said predominantly copper foil strip on said mold such that said predominantly copper foil strip corresponds to said surface configuration of said mold;

(e) manufacturing said hull portion by bonding at least one layer of a thermoplastic composite material to said predominantly copper foil strip;

(f) whereby said manufactured hull portion combines high strength, light weight and corrosion resistance.

21. The method of claim 20 wherein said at least a portion of a marine vessel hull comprises an entire marine vessel hull.

* * * * *